United States Patent [19]

Ukai

[11] Patent Number: 5,037,160

[45] Date of Patent: Aug. 6, 1991

[54] FLOORING REMOVER

[75] Inventor: Toshihide Ukai, Gifu, Japan

[73] Assignee: Act Co., Ltd., Gifu, Japan

[21] Appl. No.: 546,563

[22] Filed: Jun. 29, 1990

[30] Foreign Application Priority Data

Jun. 30, 1989 [JP] Japan ..... 1-170647

[51] Int. Cl.[5] ..... E21C 47/00; E04D 15/02

[52] U.S. Cl. ..... 299/37; 30/170; 173/24

[58] Field of Search ..... 299/36, 37; 15/93.1; 30/169, 170; 173/24; 81/45

[56] References Cited

U.S. PATENT DOCUMENTS 3,272,559 9/1966 Haynes ..... 299/37
4,444,434 4/1984 Gurries ..... 299/37 X
4,709,479 12/1987 Lavelette ..... 15/93.1 X
4,837,933 6/1989 Chapman ..... 299/37 X

*Primary Examiner*—Ramon S. Britts
*Assistant Examiner*—David J. Bagnell
*Attorney, Agent, or Firm*—Hale and Dorr

[57] ABSTRACT

An apparatus for the removal of flooring is described. The apparatus is powered by an internal combustion engine which moves a series of crawlers. A blade is attached to a blade-holder which is situated on the front of the flooring remover. The blade is moved up and down by oil cylinders powered by an oil pump, thereby changing the angle of the blade to the floor. In addition, the blade is moved forward and backward rapidly by means of a driving shaft. The operator controls the apparatus from a seat mounted on the main body of the apparatus.

1 Claim, 5 Drawing Sheets

FLOORING REMOVER

BACKGROUND OF THE INVENTION

The present invention relates to a flooring remover which removes flooring pasted down on a floor, and more particularly to a flooring remover which can precisely, as well as efficiently, remove flooring, thereby reducing the fatigue of workers.

While a number of hand tools have been utilized to remove flooring, such tools have many shortcomings such as being slow to use and requiring many workers to complete a job, all of which push up cost.

In order to overcome such shortcomings, a push-type flooring remover (B) as shown in FIG. 6, comprising an electric outlet (19), an electric cord (20), an electric motor as a power source, and a pair of tires (21) on both sides of the main body, has been proposed.

A push-type flooring remover (B) has some inconveniences, as it draws a cord (20) from an outlet (19), not only limiting operation to within the length of said cord (20) but also disabling operation where there is no such outlet (19). Further, the operator must be careful not to touch the cord (20) lying on the floor with the blade (23) of the remover (B).

The flooring remover (B) also requires the operator to lift the blade (23) and push the handle (22) at the same time, thereby weakening the operator's forward pushing force. Occasionally, the blade (23) sticks, slowing down operation, which results in a significant amount of operator fatigue. The adjustment of the height or the angle of the blade according to the kind of flooring depends upon the operator's experience, which lacks in precision of operation.

Accordingly, it is an object of the present invention to provide a flooring remover which is powerful and useful and capable of removing flooring precisely and efficiently and reducing the fatigue of the workers.

SUMMARY OF THE INVENTION

The present invention is a flooring remover comprising:

- a driving seat mounted on the main body of said flooring remover;
- means to travel by a plurality of crawlers moved by an internal-combustion engine;
- a blade holder held to the front of said flooring remover;
- a blade attached to said blade holder;
- means to fluctuate said blade up and down by oil cylinders moved by an oil pump; and
- means to change the angle of said blade.

The operation of said flooring remover constituted as above is as follows:

- an operator gets on the operation seat;
- operates said flooring remover;
- the crawlers are moved by the internal-combustion engine; and
- the body of said flooring remover shifts without slippage.

Then, the operator fluctuates the blade attached to the blade holder up and down by operating the oil cylinders moved by the oil pump, changes the angle of said blade and precisely removes flooring.

These and other aspects, objects and advantages of the present invention will become apparent from the following detailed description, particularly when taken in conjunction with the accompanying drawings.

DESCRIPTION OF THE PREFERRED EMBODIMENTS

Figure 1:
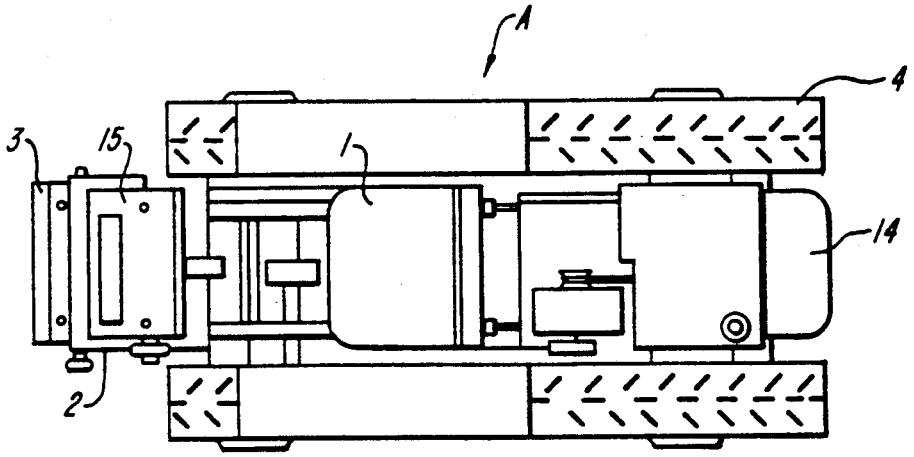
FIG. 1 is a plan view showing the flooring remover of the working example of the present invention.

Turning now to the drawings, in which similar reference characters denote similar elements throughout the several views, introduced here is the thought-to-be best example, which does not and will not limit the scope of the present invention.

Figure 2:
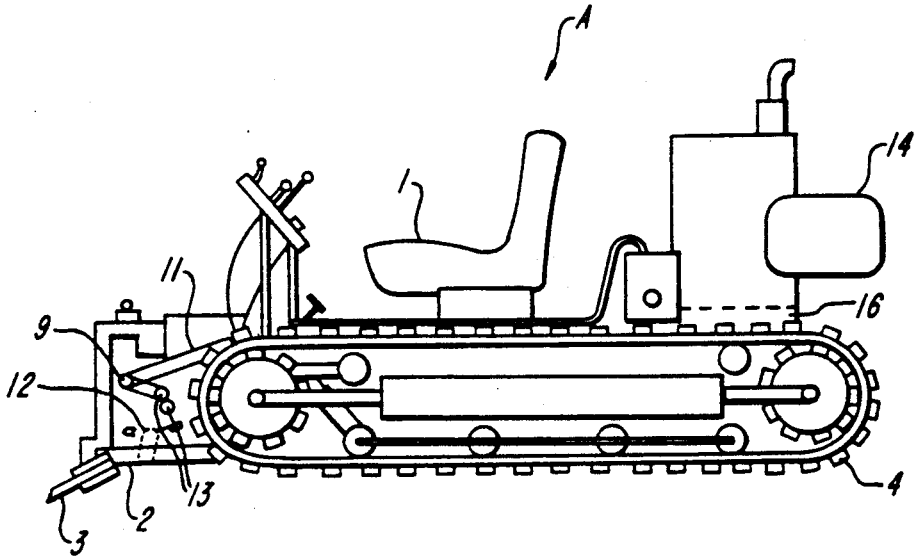
FIG. 2 is a side elevational view showing the flooring remover of the working example of the present invention.
Figure 3:
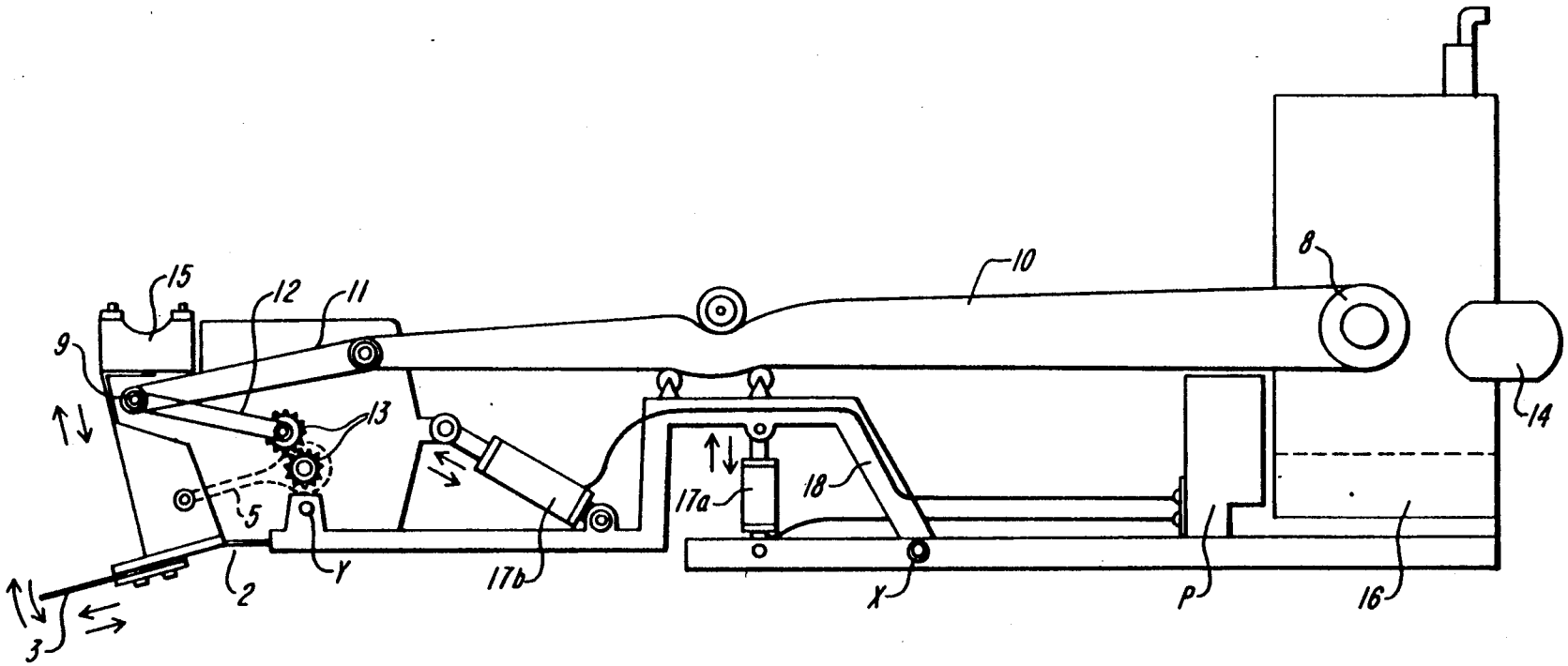
FIG. 3 is a side elevational view partly showing the flooring remover of the working example of the present invention.
Figure 4:
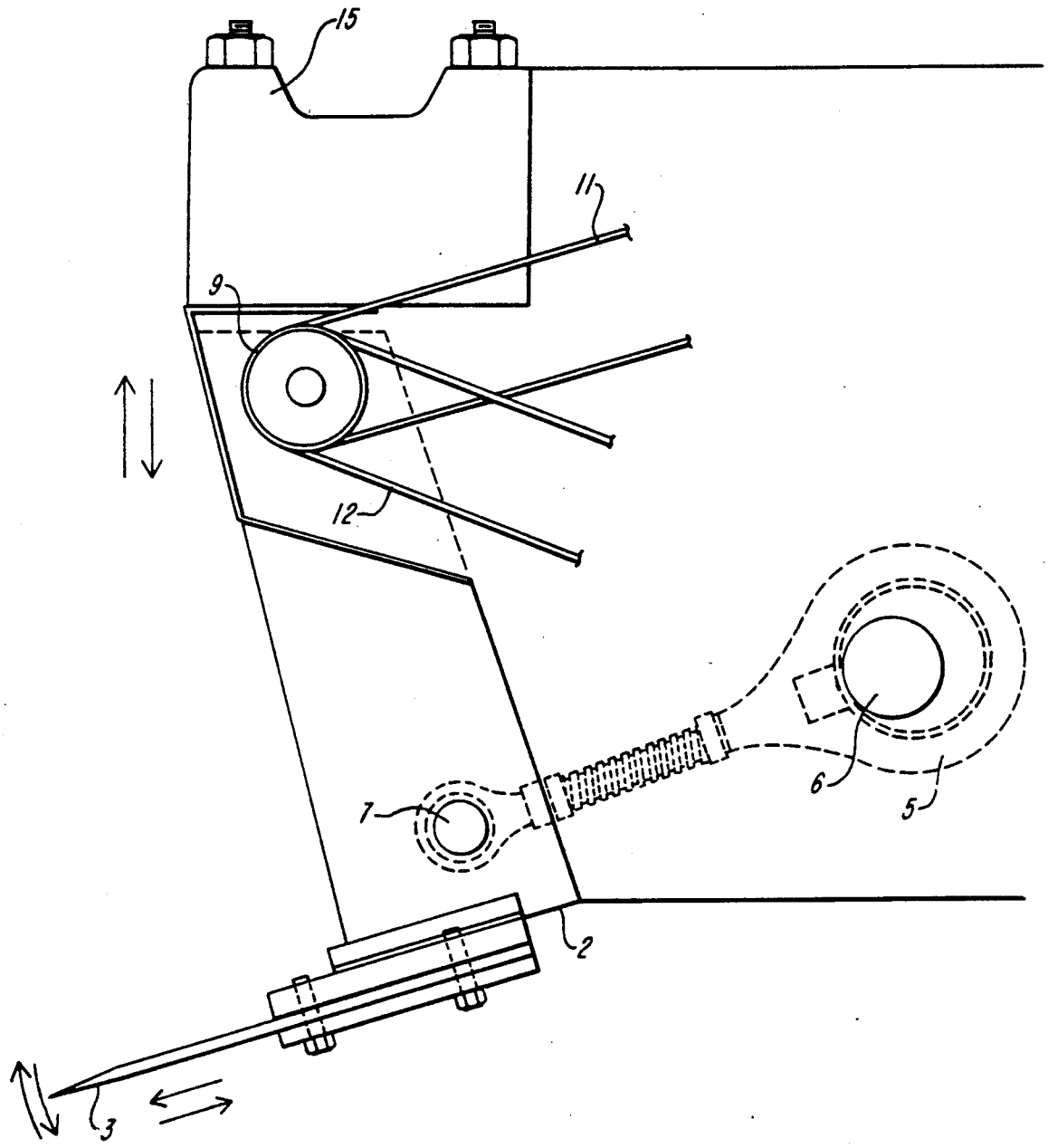
FIG. 4 is a side elevational view partly showing the blade holder of the flooring remover of the working example of the present invention.
Figure 5:
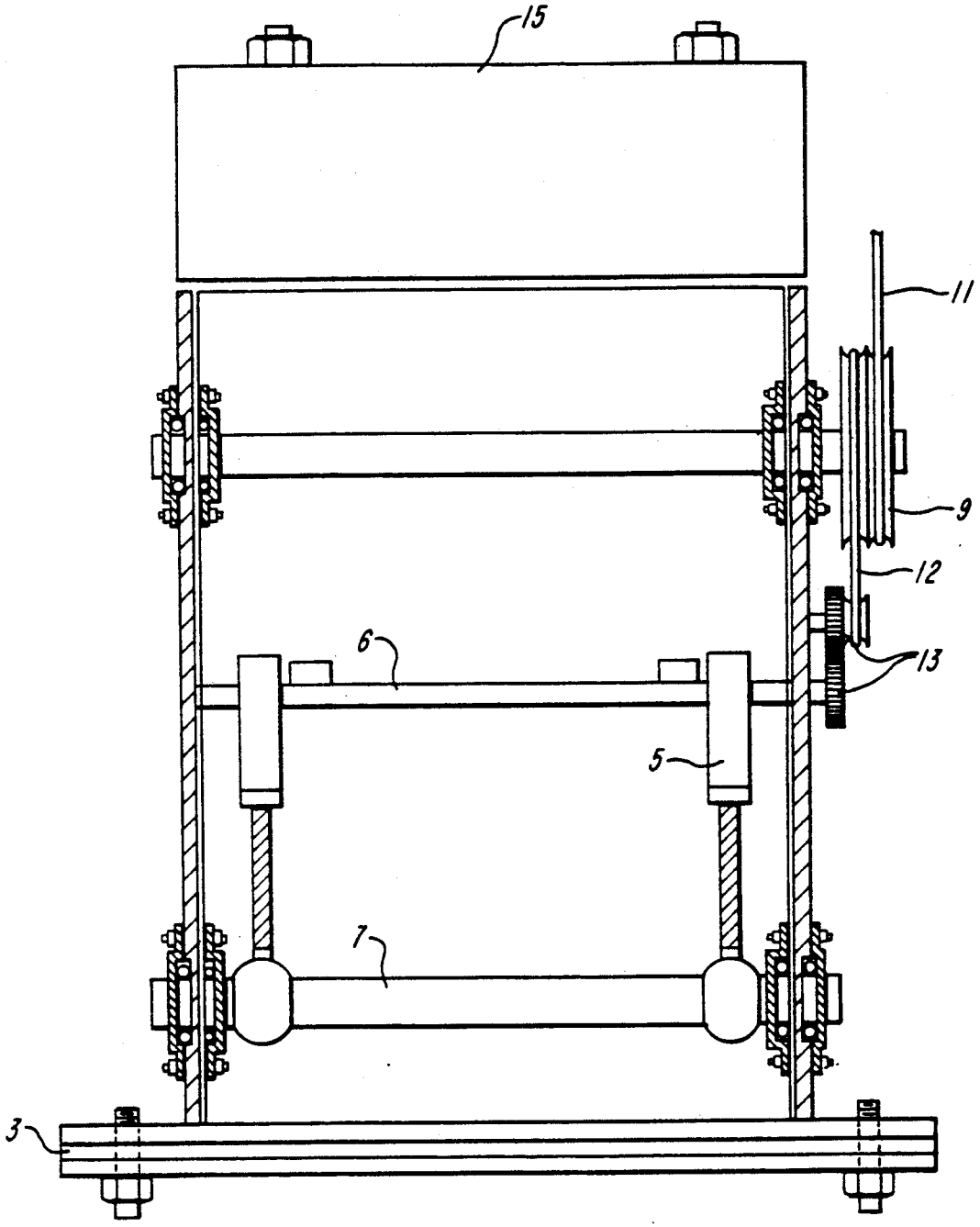
FIG. 5 is a cross-sectional view showing a section of the blade holder of the flooring remover of the working example of the present invention.
Figure 6:
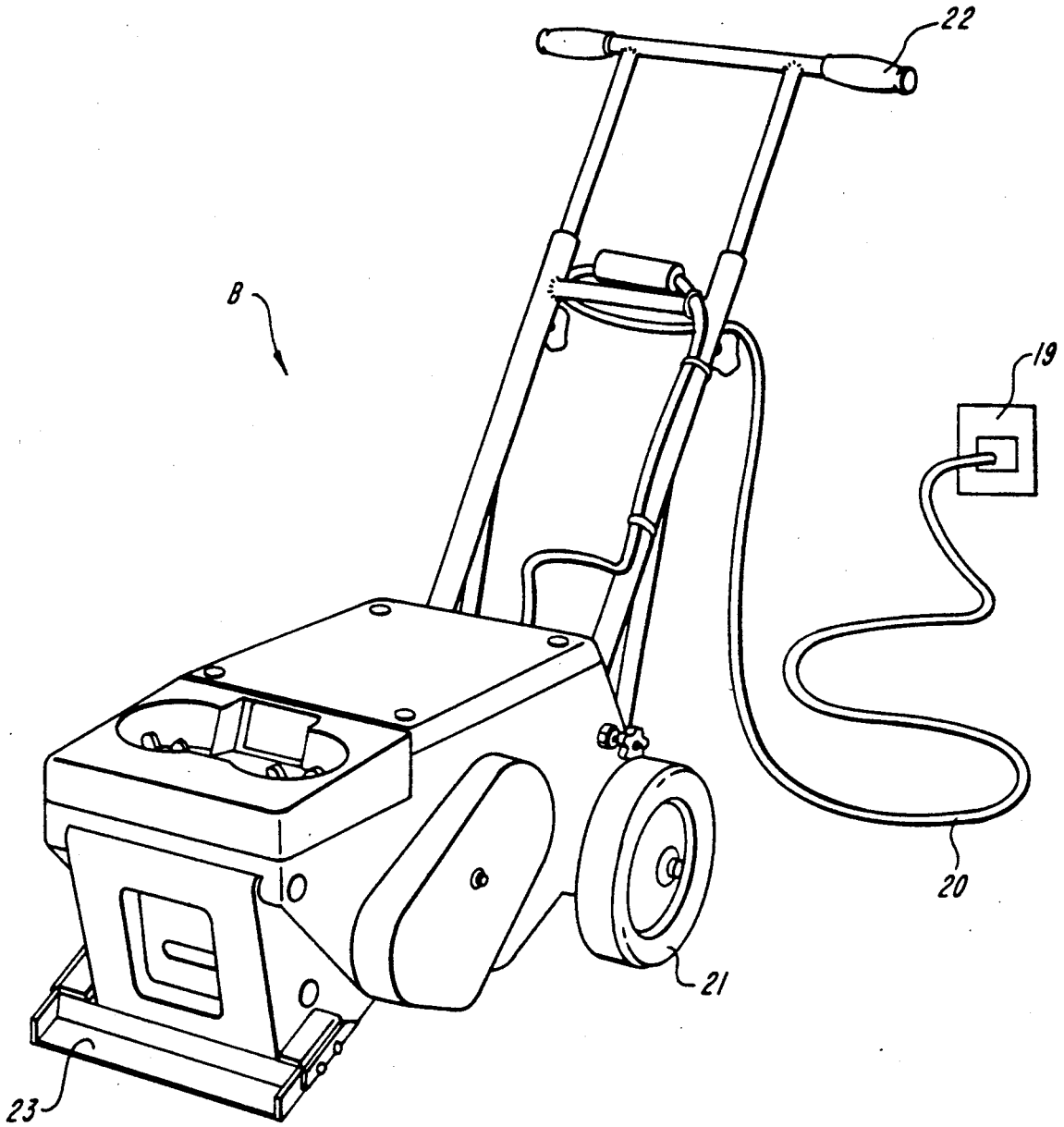
FIG. 6 (PRIOR ART)
FIG. 6 is a perspective view showing a conventional flooring remover.

As FIGS. 1–3 show, the flooring remover (A) of the present invention comprises an operation seat (1) mounted on the body, a blade holder (2) held to the front of said body, a blade (3) attached to said blade holder to remove flooring, an oil pump (P), oil cylinders (17*a*, 17*b*), a fuel tank (14), and crawlers (4), moved by an internal-combustion engine, installed on the both sides of said body. Preferably, an elastic cover material, such as rubber, is used with the crawlers in order not to damage floors.

Said flooring remover shifts as the crawlers turn, which are moved by a conventional gasoline engine not shown in the drawings.

Other types of internal-combustion engines may be used besides a gasoline engine, such as a gas oil engine or an alcohol engine, however, a gasoline engine is preferred as it provides high power. Although it is not strongly recommended, it is possible to use a battery instead of an engine as a power source.

Further, it is desirable to mount weights, one on the top part (15) of said blade holder and the other on the rear part (16) of the body, in order to strengthen the power to remove flooring and also to stabilize the body.

As shown in FIG. 3, the blade (3) held to the blade holder (2) is fluctuated up and down, as indicated by arrows, by the holding frame (18) which is fluctuated in the directions, as indicated by arrows, and turned on the pivot (X) by the oil cylinder (17*a*) which is moved by the oil pump (P). The blade holder (2) is turned on the pivot (Y) by the oil cylinder (17*b*) and the angle of the blade (3) is adjusted in the directions indicated by arrows.

Said blade (3) is removable from said blade holder (2) and when the blade (3) is damaged during operation or according to the type of flooring, the blade (3) can be changed.

The alternation motion, indicated by the arrows shown under the blade (3), of the blade (3) is performed in the following steps:

the pulley (8) is turned by said internal-combustion engine and through a transmission such as a torque converter;

the driving shaft (6) is spun by the motion of the pulley (8) through the belts (10) (11) and (12) the W-pulley (9) and the gears (13); and the cranks (5) and the swing shaft (7) are functioned by the motion above.

The number of spins of the driving shaft (6) connected to the cranks (5) can be changed in the range of 2000–4000 rpm in the case of the working example of the present invention, though, it is possible to obtain a higher number by the selection of an engine or a transmission.

The flooring remover (A) of the present invention was compared with a conventional flooring remover (B) in a work place where a floor of 900 $m^2$ was covered with flooring wall to wall. The results of the experiment are described below.

First of all, it took 20 hours for the flooring remover (A) of the present invention to remove said whole flooring of 900 $m^2$, while it took 96 hours for the conventional flooring remover (B) to accomplish the same. From this result, it is clear that it takes a much shorter time for the flooring remover (A) to remove flooring than for the conventional flooring remover (B). It is because the flooring remover (A) of the working example employs powerful crawlers (4) powered by a combustion engine and moves forward without failure, reducing idling of the blade (3). The height and the angle of the blade (3) can be adjusted precisely, which makes it possible to remove flooring precisely. Also, the blade (3) can move forward and backward rapidly owing to the rapid motion of the driving shaft (6), resulting in rapid removal of flooring.

As for the degree of fatigue, while the operator hardly felt tired after work with the flooring remover (A) of the working example, the worker felt quite tired after work with the conventional flooring remover (B). It is because the operator of the flooring remover (A) could operate in a seat, while the operator of the conventional flooring remover (B) had to push.

As for the maximum numbers of spins of driving shafts, the flooring remover (A) had 4000 rpm, while that of the conventional flooring remover (B) was 2000 rpm, and the flooring remover (A) was powered by a gasoline engine, while the conventional flooring remover (B) was powered by an electric motor.

As explained in detail above, the flooring remover of the present invention has the following effects:

1. The blade holder, moved by oil cylinders which are powered by an oil pump, is capable of fluctuating the blade up and down and changing the angle of the blade up and down to adjust the height as well as the angle of the blade to suit the type of flooring and the shape of a floor in order to make a precise operation possible;

Further, when it is not in use, it is possible to move the body away without damaging a floor by holding the blade up;

2. The body travels by the movement of the crawlers on the both away sides of the body which are powered by a combustion engine which is naturally more powerful than an electric motor, reducing slippage as well as raising work efficiency by reducing idling of the blade;

Further, a change of directions can be performed smoothly in a relatively small work place by stopping the motion of one of the crawlers, giving the flooring remover excellent maneuverability;

3. The operator feels less fatigue as he can sit on the seat during operation; and 4. It is possible to operate the flooring remover in a work place where there are no electric outlets; and there is no worry as to the lengths of electric cords.

Additions, subtractions, deletions and other modifications of the described embodiments will be apparent to those practiced in the art and are within the scope of the following claims.

What is claimed is:

1. A flooring remover comprising:

a driving seat mounted on the main body of said flooring remover;

means to travel by crawlers moved by an internal-combustion engine;

a blade holder held to the front of said main body;

a blade to remove flooring, attached to said blade holder;

means to fluctuate said blade up and down to change the depth of flooring removed;

means to change the angle of said blade relative to the surface over which the flooring remover travels, said means to fluctuate and said means to change the angle being controlled by oil cylinders powered by an oil pump; and means for reciprocating said blade along a straight path so that said blade moves toward and away from said flooring at a constant angle to said flooring when the angle of said blade is fixed.

* * * * *